US010875209B2

(12) United States Patent
Demuth et al.

(10) Patent No.: US 10,875,209 B2
(45) Date of Patent: Dec. 29, 2020

(54) WATERJET CUTTING TOOL

(71) Applicant: NuWave Industries Inc., Marwayne (CA)

(72) Inventors: Kade Demuth, Pierceland (CA); Tim Sharp, Marwayne (CA); Mark Nekurak, Drayton Valley (CA); Marlin Belanger, Drayton Valley (CA)

(73) Assignee: NUWAVE INDUSTRIES INC., Marwayne (CA)

( * ) Notice: Subject to any disclaimer, the term of this patent is extended or adjusted under 35 U.S.C. 154(b) by 183 days.

(21) Appl. No.: 16/011,568

(22) Filed: Jun. 18, 2018

(65) Prior Publication Data

US 2018/0361610 A1 Dec. 20, 2018

Related U.S. Application Data

(60) Provisional application No. 62/521,800, filed on Jun. 19, 2017.

(51) Int. Cl.

| | |
|---|---|
| ***E21B 29/00*** | (2006.01) |
| ***B26F 3/00*** | (2006.01) |
| ***B24C 3/06*** | (2006.01) |
| ***E21B 7/18*** | (2006.01) |
| *B24C 5/02* | (2006.01) |

(52) U.S. Cl.

CPC ..... *B26F 3/004* (2013.01); *B24C 3/06* (2013.01); *E21B 7/18* (2013.01); *E21B 29/007* (2013.01); *B24C 3/062* (2013.01); *B24C 5/02* (2013.01)

(58) Field of Classification Search

CPC . E21B 29/007; E21B 7/18; B24C 5/02; B24C 3/06; B24C 3/062; B26F 3/004

See application file for complete search history.

(56) References Cited

U.S. PATENT DOCUMENTS

| | | | | | |
|---|---|---|---|---|---|
| 2,717,476 | A | * | 9/1955 | Myers | B24C 7/0084 451/102 |
| 4,080,762 | A | * | 3/1978 | Watson | B24C 5/02 451/102 |
| 4,112,797 | A | * | 9/1978 | Pearl | B26D 7/20 83/177 |
| 4,651,476 | A | * | 3/1987 | Marx | B26F 3/008 451/40 |
| 4,848,042 | A | * | 7/1989 | Smith | B24C 1/045 451/78 |

(Continued)

FOREIGN PATENT DOCUMENTS

| | | |
|---|---|---|
| CA | 1147255 A | 5/1983 |
| CA | 1160212 A | 1/1984 |

(Continued)

*Primary Examiner* — Daniel P Stephenson

(74) *Attorney, Agent, or Firm* — Foley & Lardner LLP

(57) ABSTRACT

A waterjet cutting tool for radial connection to a wellbore casing for cutting the wellbore casing or associated components thereof is disclosed herein. The waterjet cutting tool comprises a waterjet nozzle for outputting a cutting solution at high pressure, the waterjet nozzle for connection to a cutting solution source; a radial adjustment unit for radially associating the waterjet nozzle to the wellbore; and an annular adjustment assembly for mount of the waterjet nozzle thereto, for allowing annular movement of the waterjet nozzle about a vertical axis of the wellbore.

18 Claims, 9 Drawing Sheets

(56) References Cited

U.S. PATENT DOCUMENTS

| | | | | | |
|---|---|---|---|---|---|
| 4,850,423 | A * | 7/1989 | Allen | F28G 3/163 | 165/5 |
| 5,320,289 | A * | 6/1994 | Hashish | B24C 1/045 | 239/434 |
| 5,332,293 | A * | 7/1994 | Higgins | B26F 3/004 | 239/101 |
| 5,505,653 | A * | 4/1996 | Nedo | B23Q 1/0018 | 451/100 |
| 6,222,155 | B1 * | 4/2001 | Blackmon | B23K 7/002 | 219/121.39 |
| 6,305,261 | B1 * | 10/2001 | Romanini | B24C 1/045 | 451/102 |
| 6,379,214 | B1 * | 4/2002 | Stewart | B23Q 5/58 | 451/10 |
| 6,837,775 | B2 * | 1/2005 | Anand | B24C 5/04 | 451/102 |
| 7,617,871 | B2 * | 11/2009 | Surjaatmadja | E21B 43/114 | 166/298 |
| 7,793,896 | B2 * | 9/2010 | Pfarr | B26F 3/004 | 248/121 |
| 8,448,880 | B2 * | 5/2013 | Hashish | B24C 3/325 | 239/434 |
| 8,528,453 | B2 * | 9/2013 | Hamann | B24C 1/045 | 83/177 |
| 9,156,133 | B2 * | 10/2015 | Miller | B24C 1/045 | |
| 9,370,871 | B2 * | 6/2016 | Hashish | B24C 1/045 | |
| 2018/0361610 | A1 * | 12/2018 | Demuth | B26F 3/004 | |
| 2020/0078977 | A1 * | 3/2020 | Caroselli | B26F 3/004 | |

FOREIGN PATENT DOCUMENTS

| | | | |
|---|---|---|---|
| CA | 1211043 | A | 9/1986 |
| CA | 1212101 | A | 9/1986 |
| CA | 1241826 | A | 9/1988 |
| CA | 1254505 | A | 5/1989 |
| CA | 2016405 | A1 | 11/1990 |
| CA | 2090242 | A1 | 12/1992 |
| CA | 2217056 | A1 | 10/1996 |
| CA | 2208813 | A1 | 1/1998 |
| CA | 2232051 | A1 | 9/1998 |
| CA | 2253687 | A1 | 5/1999 |
| CA | 2298798 | A1 | 8/2000 |
| CA | 2438139 | A1 | 8/2002 |
| CA | 2369669 | A1 | 9/2002 |
| CA | 2115543 | C | 11/2002 |
| CA | 2405391 | A1 | 3/2003 |
| CA | 2405608 | A1 | 3/2003 |
| CA | 2405631 | A1 | 3/2003 |
| CA | 2212199 | C | 7/2003 |
| CA | 2225571 | C | 9/2003 |
| CA | 2466139 | A1 | 11/2004 |
| CA | 2600094 | A1 | 10/2005 |
| CA | 2563758 | A1 | 11/2005 |
| CA | 2568909 | A1 | 12/2005 |
| CA | 2589798 | A1 | 6/2006 |
| CA | 2694074 | A1 | 6/2006 |
| CA | 2595018 | A1 | 7/2006 |
| CA | 2535534 | A1 | 8/2006 |
| CA | 2611928 | A1 | 12/2006 |
| CA | 2621572 | A1 | 3/2007 |
| CA | 2624697 | A1 | 4/2007 |
| CA | 2675223 | A1 | 7/2008 |
| CA | 2694146 | A1 | 2/2009 |
| CA | 2705570 | A1 | 6/2009 |
| CA | 2701485 | A1 | 7/2011 |
| CA | 2787141 | A1 | 7/2011 |
| CA | 2787332 | A1 | 8/2011 |
| CA | 2817724 | A1 | 5/2012 |
| CA | 2837713 | A1 | 12/2012 |
| CA | 2841119 | A1 | 1/2013 |
| CA | 2884414 | A1 | 3/2014 |
| CA | 2898728 | A1 | 8/2014 |
| CA | 2902051 | A1 | 11/2014 |
| CA | 2915682 | A1 | 2/2015 |
| CA | 2927689 | A1 | 5/2015 |
| CA | 2927119 | A1 | 6/2015 |
| CA | 2942014 | A1 | 12/2015 |

* cited by examiner

WATERJET CUTTING TOOL

RELATED APPLICATION

This application claims priority to U.S. Provisional Patent Application No. 62/521,800, filed Jun. 19, 2017, herein incorporated by reference in its entirety.

TECHNICAL FIELD

The invention relates to cutting tools and more specifically to waterjet cutting tools for use in cutting wellbore casings and components used in or associated to wellbore casings.

BACKGROUND

Oilfield wellheads and spools have various attachments, referred to herein and encompassed by the expression wellbore casings and associated components, that require adjustment, replacement, or removal from time to time through normal operation of the well, or in the process of abandonment of the well. These components can be difficult to remove when corroded or otherwise worn or seized in place.

Conventional hand tools may not be effective in removing these components and "hot methods" such as torch cutting, heating, drilling and machining for removal are often not acceptable because of the explosive nature of the well and its environment.

To use conventional methods requires that the well be isolated through different processes that are time consuming and expensive. Conventional methods can also cause damage to the wellhead, casings or related or associated components.

Safer and/or more convenient methods are desired to eliminate or reduce the risk of explosion and/or to provide faster or more convenient setup, adjustment and/or cutting and/or to carry out less costly component removal for repairs or abandonment.

SUMMARY OF THE INVENTION

A waterjet cutting tool that connects to a wellbore casing or suitable associated component thereof is provided. The waterjet cutting tool uses a cutting solution, typically comprising water and an abrasive, that may be used to cut various components of a well including for example a wellbore casing, flanges, connectors, liners, valves, piping, etc. The waterjet cutting tool includes both a radial adjustment capability and an annular adjustment capability allowing for movement of the cutting nozzle about at least a portion of the wellbore casing. In this way, various components of the well may be cut and removed as necessary to carry out maintenance, replacement of components, additional of components and/or abandonment of the well as desired.

In one embodiment, the present invention provides for a waterjet cutting tool for radial connection to a wellbore casing for cutting the wellbore casing or suitable components thereof, the waterjet cutting tool comprising:

- a waterjet nozzle for outputting a cutting solution at high pressure, the waterjet nozzle for connection to a cutting solution source;
- a radial adjustment unit for radially associating the waterjet nozzle to the wellbore; and

- an annular adjustment assembly for mount of the waterjet nozzle thereto, for allowing annular movement of the waterjet nozzle about a vertical axis of the wellbore.

In a further embodiment of the waterjet cutting tool or tools as outlined above, the tool further comprises a carriage assembly in communication with the radial adjustment unit and the annular adjustment assembly, onto which the waterjet nozzle is directly or indirectly mounted.

In a further embodiment of the waterjet cutting tool or tools as outlined above, the waterjet cutting tool further comprises a connection device for associating the waterjet cutting tool to the wellbore casing or suitable component thereof.

In a further embodiment of the waterjet cutting tool or tools as outlined above, the connection device comprises:

- a spigot shaft for insertion into a tubing hanger,
- a spigot adapter for connection with the spigot shaft and securely placeable in a tubing hanger of the wellbore casing;
- a bearing mounted on the spigot shaft; and
- a sector gear bracket connected to the bearing onto which a component of the annular adjustment assembly may be connected.

In a further embodiment of the waterjet cutting tool or tools as outlined above, the radial adjustment unit is radially adjustable relative a vertical axis of the wellbore by means of a radially adjusting assembly.

In a further embodiment of the waterjet cutting tool or tools as outlined above, the radially adjusting assembly comprises a adjustment member for radial orientation relative the wellbore and an adjustment control operationally associated with the adjustment member for controlling the radial distance of the waterjet nozzle from the wellbore casing or suitable component.

In a further embodiment of the waterjet cutting tool or tools as outlined above, the carriage assembly and radial guide track each comprise a guide element adapted for interaction therebetween for guiding the carriage assembly along the radial guide track.

In a further embodiment of the waterjet cutting tool or tools as outlined above, the radial adjusting assembly is integrated into the carriage assembly.

In a further embodiment of the waterjet cutting tool or tools as outlined above, the adjustment member is a threaded member and the adjustment control is a hand wheel or powered wheel.

In a further embodiment of the waterjet cutting tool or tools as outlined above, the annular adjustment assembly comprises an annular sector gear track for interaction with a carriage pinion gear mounted on the carriage assembly for guiding the carriage assembly along the sector gear track thereby adjusting the annular position of the nozzle when the carriage pinion gear is activated.

In a further embodiment of the waterjet cutting tool or tools as outlined above, the annular sector gear track has an annular curve such that movement along the annular sector gear track by the carriage assembly maintains a substantially consistent distance of the carriage assembly from the vertical axis of the wellbore when the cutter tool is connected to the wellbore casing.

In a further embodiment of the waterjet cutting tool or tools as outlined above, the tool further comprises a drive motor for driving the carriage assembly along the annular sector gear track.

In a further embodiment of the waterjet cutting tool or tools as outlined above, the drive motor is a carriage drive motor and the carriage pinion gear is a drive gear and the carriage drive motor is in connection with the carriage pinion drive gear for driving the carriage assembly along the annular sector gear track.

In a further embodiment of the waterjet cutting tool or tools as outlined above, the annular adjustment assembly further comprises a waterjet nozzle position adjustment assembly for vertically and/or horizontally adjusting the position of the waterjet nozzle.

In a further embodiment of the waterjet cutting tool or tools as outlined above, the waterjet nozzle position adjustment assembly allows for 3-dimensional adjustment and orientation of the waterjet nozzle.

In yet a further embodiment, the present invention provides for a waterjet cutting tool for radial connection to a wellbore casing for cutting the wellbore casing or suitable components thereof, the waterjet cutting tool comprising:

- a waterjet nozzle for outputting a cutting solution at high pressure, the waterjet nozzle for connection to a cutting solution source;
- a radial adjustment unit for radially associating the waterjet nozzle to the wellbore;
- an annular adjustment assembly for mount of the waterjet nozzle thereto, for allowing annular movement of the waterjet nozzle about a vertical axis of the wellbore;
- a carriage assembly in communication with the radial adjustment unit and the annular adjustment assembly, onto which the waterjet nozzle is directly or indirectly mounted; and
- a connection device for associating the waterjet cutting tool to the wellbore casing or suitable component thereof, the connection device comprises:
  - a spigot shaft for insertion into a tubing hanger,
  - a spigot adapter for connection with the spigot shaft and securely placeable in a tubing hanger of the wellbore casing;
  - a bearing mounted on the spigot shaft; and a sector gear bracket connected to the bearing onto which a component of the annular adjustment assembly may be connected.

DETAILED DESCRIPTION

Described herein are embodiments of waterjet cutting tools and methods of making and using same that are intended to be illustrative of the inventive concept and are not intended to be limiting in any way. Various modifications, adjustments, revisions, substitutions and/or alterations to the tools, methods and uses described herein may be carried out without departing from the scope or spirit of the invention and are intended to be within the scope of the invention.

It will be appreciated that reference to a wellbore casing or casing herein is intended to also encompass any suitable components associated to a wellbore casing that a waterjet cutting tool may be used to cut, mount thereto, or brace thereagainst, including but not limited to, a wellbore head and/or wellhead, casings, casing hangers, flanges, connectors and components thereof including studs, dog bolts, etc., piping, valves, liners, strings, production well casings and components thereof, steam injection wells and components thereof, etc.

Further, it will be appreciated that reference to a wellbore casing or casing when used in connection with the attachment or association of the waterjet cutting tool encompasses but is not limited to the attachment of the waterjet cutting tool to a wellbore casing, casing head, suitable flange, wellhead or any suitable generally round or cylindrical component of the well onto which the cutting tool may be connected or associated. Attachment of the waterjet cutting tool to a central component of the well, such as the tubing hanger via a spigot adapter that threads into the tubing hanger, that is at the center of the wellhead is ideal. Attachment to central component allows for ease of set up, manipulation of the cutter about the casing and ease of adjustment between cuts as the waterjet cutting tool is connected to a centralized position and is therefore more easily centered itself and more easily manoeuvered about a central position for making cuts.

In various embodiments, the present invention provides for a waterjet cutting tool that may be connected to a wellbore casing, or suitable associated or related components thereof as referred to above such as a casing head or mating flange, for cutting the wellbore casing or suitable components thereof using a suitably high pressure cutting solution.

In certain embodiments of the waterjet cutting tool, a waterjet nozzle may annularly rotate about the wellbore casing or a vertical axis thereof for at least a portion of the circumference of the wellbore casing allowing for cutting of the wellbore casing. The waterjet cutting tool may also be adapted such that it maintains the waterjet nozzle at a substantially consistent radial distance from the wellbore casing as it is rotated about the casing.

In this way, various components of the well may be cut and removed as necessary to carry out maintenance, replacement of components, additional of components and/or abandonment of the well as desired.

Figure 5:
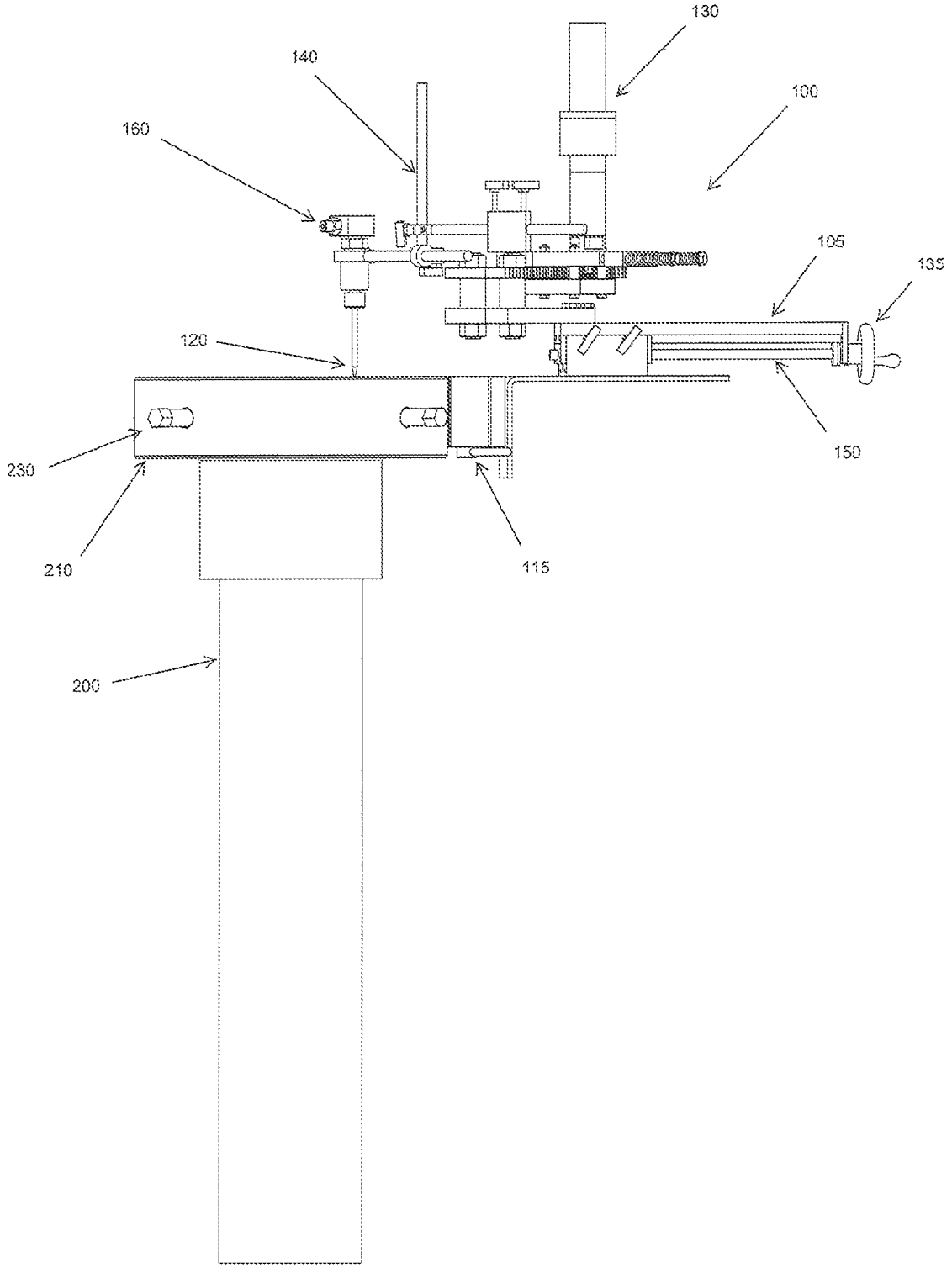
FIG. 5 is a side view illustrative of one embodiment of a waterjet cutting tool connected to a casing head of a wellbore wherein the waterjet nozzle is oriented to cut in a vertical cutting position.
Figure 6:
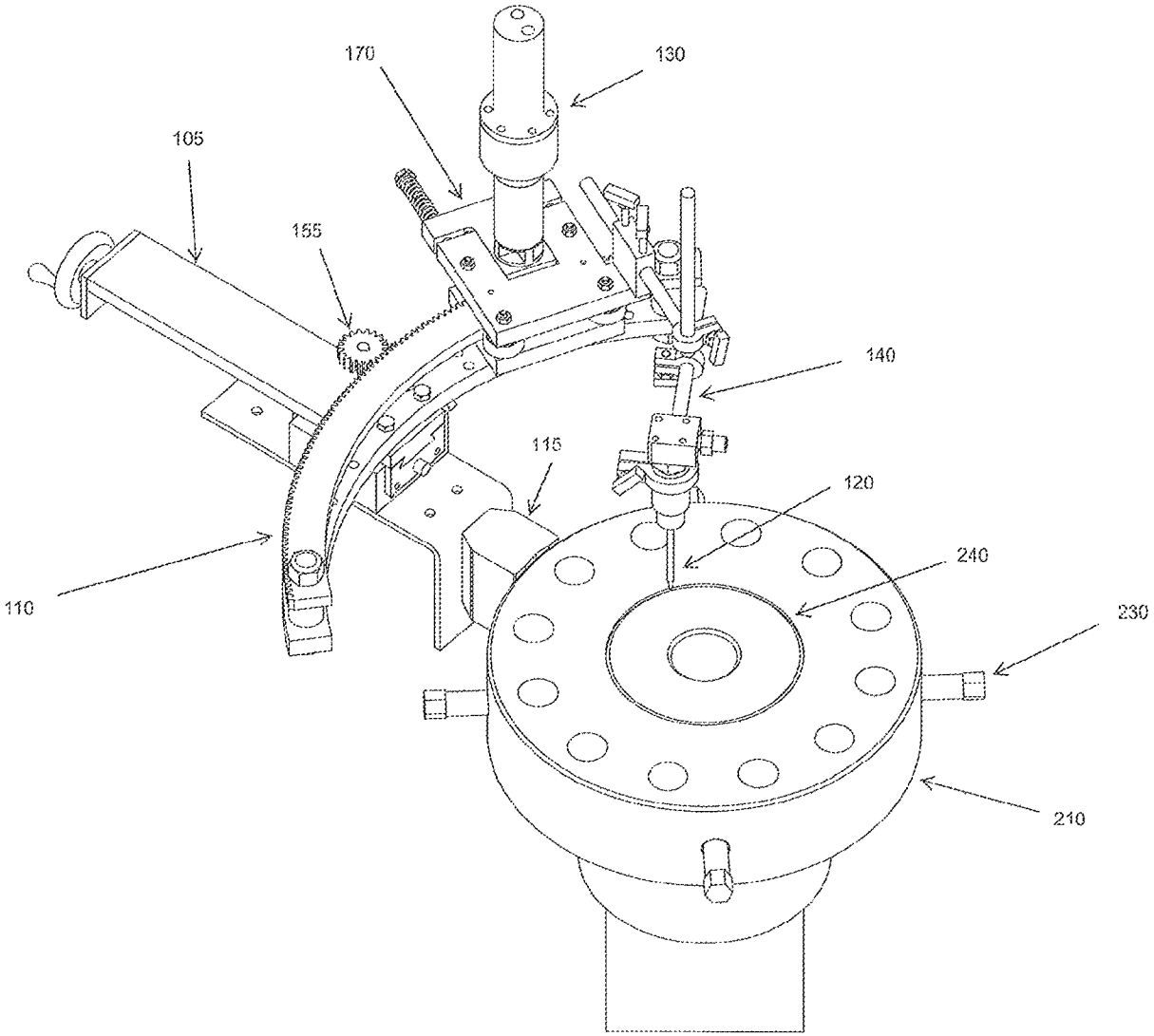
FIG. 6 is an isometric view illustrative of one embodiment of the waterjet cutting tool shown in FIG. 6 connected to a casing head of a wellbore wherein the waterjet nozzle is oriented to cut in a vertical cutting position.

One embodiment of a waterjet cutting tool is shown with reference to FIGS. 1 to 4B wherein the waterjet cutting tool is shown in a substantially horizontal cutting orientation while the waterjet cutting tool is shown in a substantially vertical cutting orientation with reference to FIGS. 5 and 6 and is shown generally at 100 throughout FIGS. 1 to 6. The waterjet cutting tool is also shown using an alternative attachment device in FIGS. 7 to 9, wherein the waterjet cutting tool is attached to the wellhead using a spigot adaptor threaded into the tubing hanger.

Figure 1:
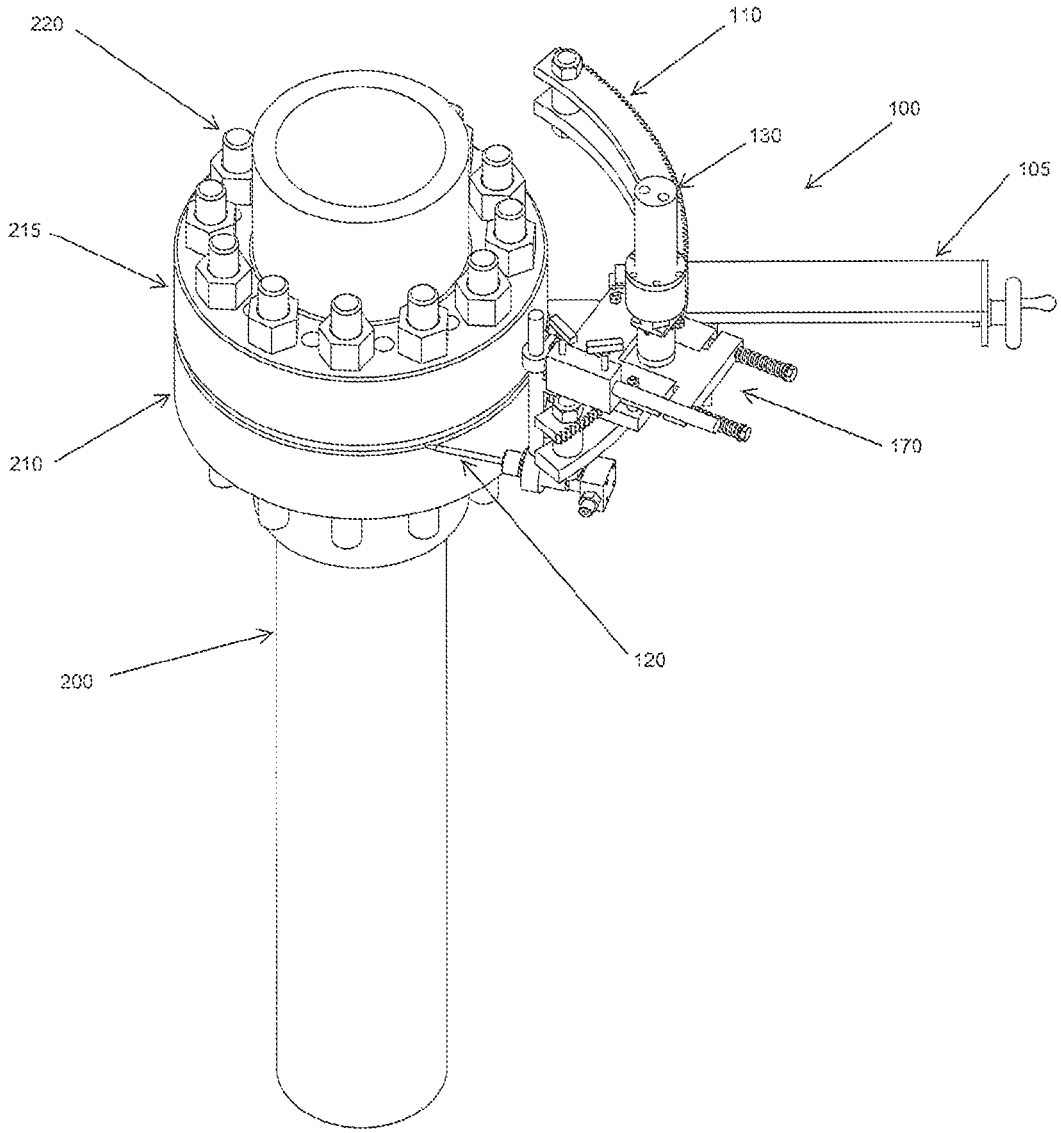
FIG. 1 is an isometric view illustrative of one embodiment of a waterjet cutting tool connected to a casing head of a wellbore wherein the waterjet nozzle is oriented to cut in a horizontal cutting position.
Figure 2:
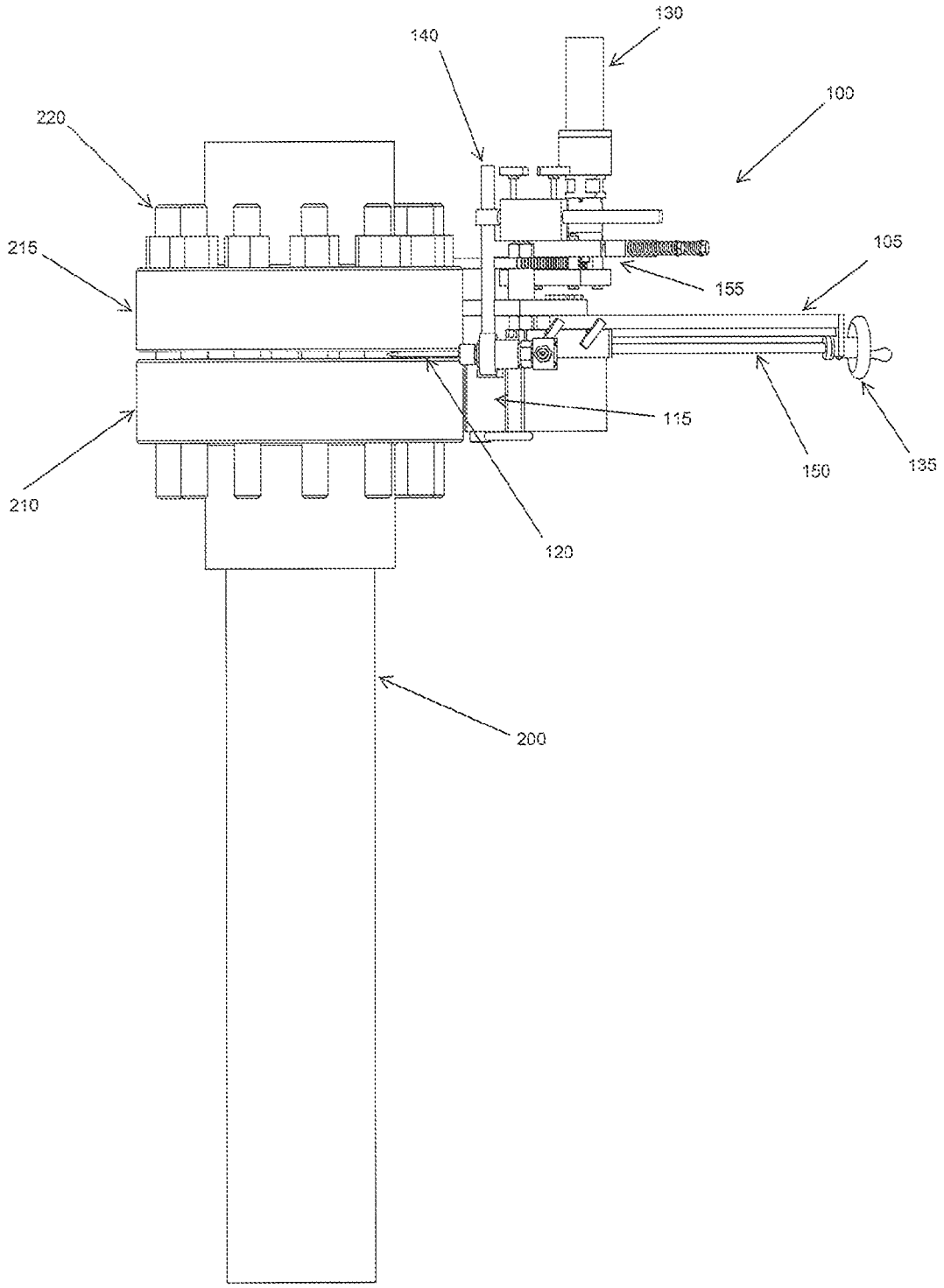
FIG. 2 is a side view illustrative of one embodiment of the waterjet cutting tool shown in FIG. 1 connected to a casing head of a wellbore wherein the waterjet nozzle is oriented to cut in a horizontal cutting position.
Figure 3A:
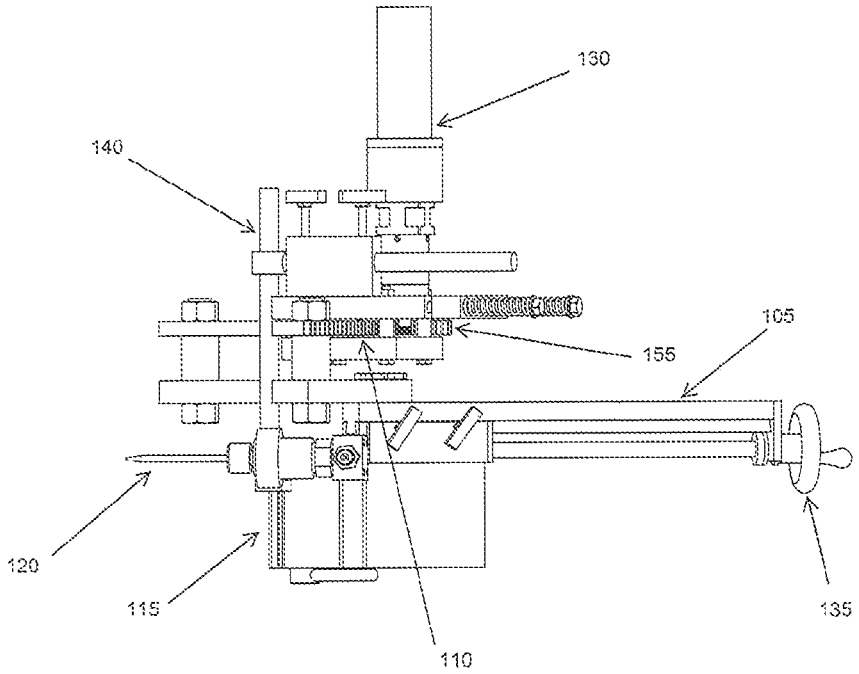
FIGS. 3A and 3B are a side view and an isometric view, respectively, illustrative of one embodiment of a waterjet cutting tool.
Figure 3B:
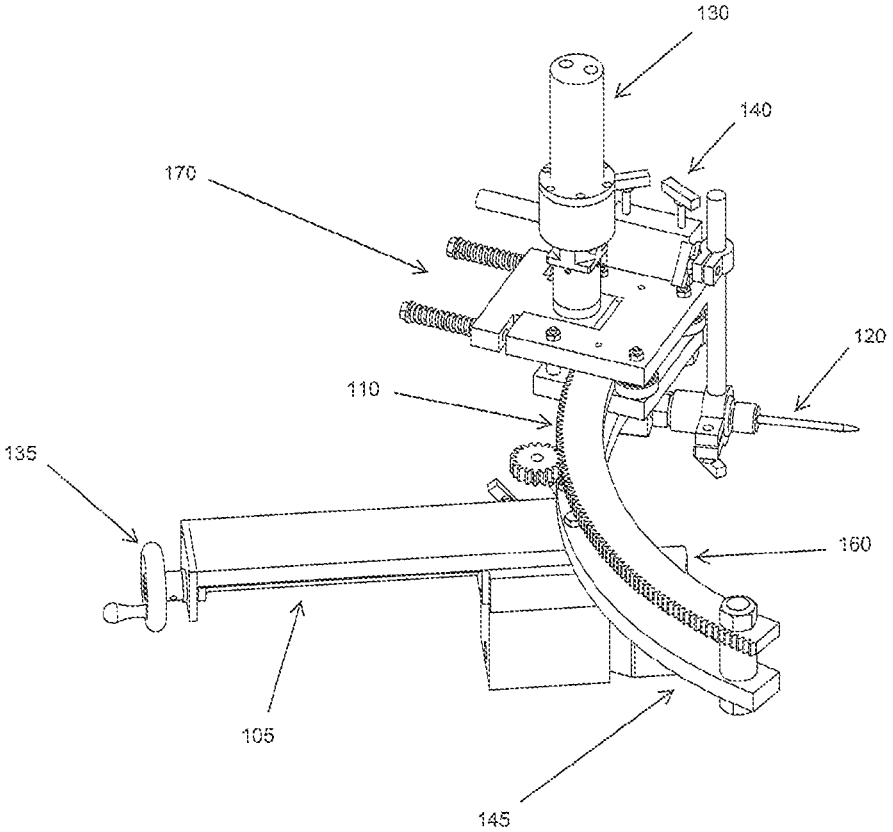
Figure 4B:
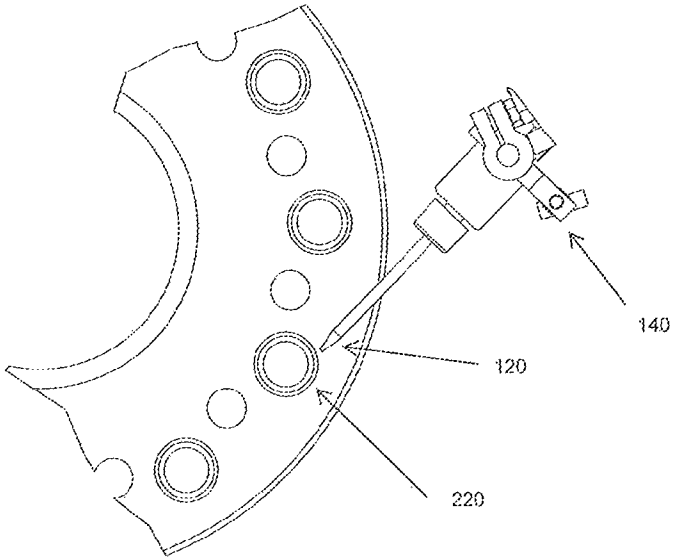
FIG. 4B is a top view illustrative of one embodiment of the waterjet cutting tool of FIG. 4A oriented to cut a component associated to a wellbore casing in the form of a flange connection stud.
Figure 4A:
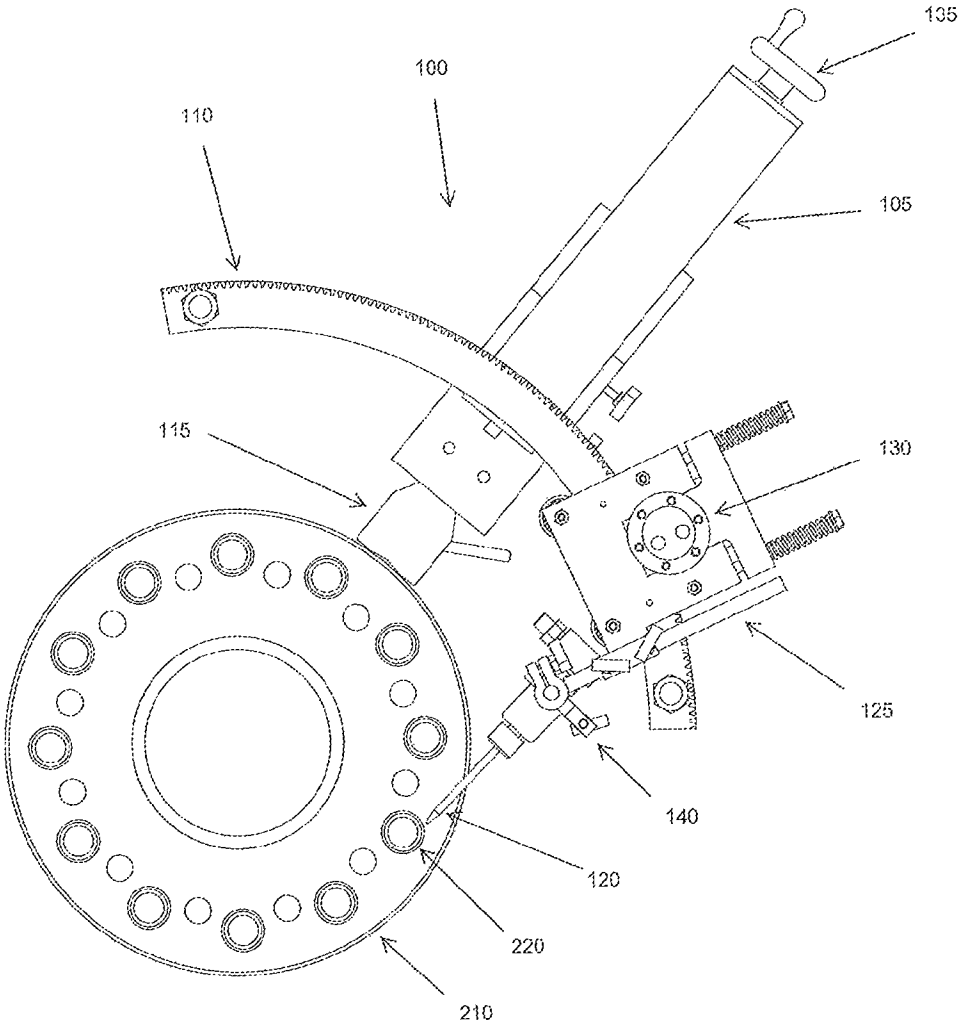
FIG. 4A is a top view illustrative of one embodiment of one embodiment of a waterjet nozzle of a waterjet cutting tool oriented to cut a component associated to a wellbore casing in the form of a flange connection stud.

In FIGS. 1 and 2, the waterjet cutting tool 100 is shown connected to a casing head 210. In the embodiments shown throughout FIGS. 1 to 6, the tool 100 is comprised of a radial adjustment assembly, an annular adjustment assembly and a waterjet nozzle 120. The radial adjustment assembly is used to adjust the radial spacing of the waterjet nozzle 120 laterally from the well casing 200 or a vertical axis thereof onto which the tool 100 is attached. The annular adjustment assembly is used to allow annular movement of the waterjet nozzle 120 about the casing 200 or a vertical axis thereof. In various embodiments the annular adjustment assembly is annularly curved such that a consistent radial distance of the waterjet nozzle 120 from the well casing 200 may be maintained during annular movement of the waterjet nozzle 120 by adjusting the radial distance. The waterjet nozzle 120 is used to cut the casing 200 or suitable components thereof.

In the embodiments shown in FIGS. 1 to 6, the radial adjustment assembly comprises a connection device for associating the tool 100 to the wellbore casing. In the embodiments shown the connection device is a magnet 115 which may be optionally clamped to the casing 200 or suitable components thereof such as the casing head 210, the mating flange 215. or the wellhead or component thereof such as the tubing hanger or spigot adapter (as discussed in more detail with reference to FIGS. 7 to 9), to further secure tool 100 to the well casing 200. It will be appreciated that reference herein to "association" or "connection" or "attachment" is interchangeable and each term encompasses a disconnectable connection of the tool to the well casing and encompasses both a magnetic association to the well casing as well as or alternatively any suitable connections or attachment mechanism including but not limited to a clamped, bolted or threaded connection or bracket or welded connection and encompasses any suitable connecting or associated means or devices that may be used to connect the tool 100 to a wellbore casing. Further, although a single magnet is shown, any suitable number of magnets may be used alone or in conjunction with further attachment means or mechanisms.

As outlined above, the tool may alternatively be attached to the spigot adapter threaded into the tubing hanger. This centers the tool about a centralized position thereby maintaining the tool a consistent radial distance during annular rotation of the tool. The spigot adapter may be installed first into the tubing hanger as well as the shaft. The cutting tool can then be installed on the shaft with a bearing and the height of the tool can be adjusted to orient the nozzle in a desired location.

In addition, to help reduce flexing of the tool when pressurized or during changes in pressurization, one or more stabilizer arms may be employed to brace the tool, for example, against the wellhead, casing, or suitable components thereof.

The radial adjustment assembly also comprises a radial adjustment unit 105 for allowing adjustment of the radial distance of the nozzle 120 laterally from the well casing 200. This may include for example a threaded rod or component that may be rotated by a hand wheel 135, or machine driven mechanism causing radial movement of the nozzle 120. It will be appreciated that any suitable device or setup may be used that allows for radial adjustment such as a scissor mechanism, and the invention is not limited to threaded adjustment and encompasses both hand and mechanised operation of the adjustment assembly.

Attached to the radial adjustment assembly is the annular adjustment assembly. In the embodiments shown in FIGS. 1 to 6 the annular adjustment assembly comprises a radial guide track 145 having an annular shape. The radial guide track 145 supports a sector gear track 110 onto which a carriage assembly 170 is mounted. The carriage assembly 170 includes a carriage pinion gear 155 in operational contact with the sector gear track 110 allowing annular movement of the carriage assembly 170 along the sector gear track 110. The waterjet nozzle 120 is mounted to the carriage assembly 170 and thus is annularly moved about the casing 200 or a vertical axis thereof as the carriage assembly 170 moves along the sector gear track 110. The radial guide track 145 and/or the sector gear track 110 may be adapted to extend around a portion of the circumference of the casing or may be adapted to extend about the full circumference of the casing in which case at least the sector gear 110 would be a full ring.

By controlling the radial adjustment unit 105 to adjust the radial distance between the carriage assembly 170 and the casing 200, a proper radial distance may be selected that allows for a substantially consistent distance between the carriage assembly 170 and attached nozzle 120 and the casing or the vertical axis thereof during travel of the carriage assembly 170 along the sector gear track 110.

It will be appreciated that the sector gear track 110 and the carriage pinion gear 155 are simply illustrative of one potential setup for allowing annular movement of the carriage assembly about the casing or vertical axis thereof. Any suitable setup may be used, for example a track with ball bearings, a track with wheels, a tongue and grove, etc. for guiding the carriage assembly 170 annularly about the casing.

Figure 7:
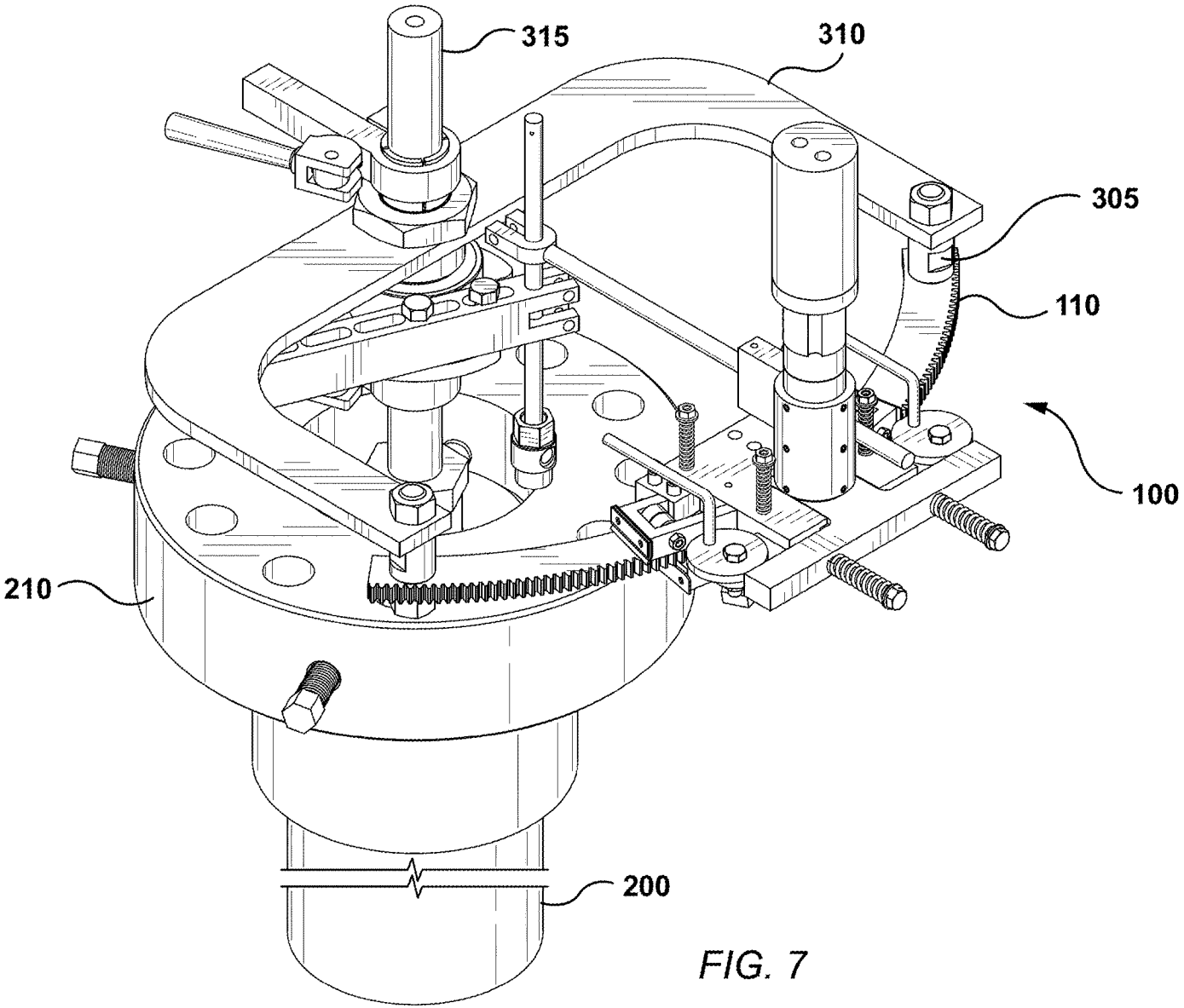
FIG. 7 is an isometric view illustrative of another embodiment of a waterjet cutting tool mounted to the wellhead view a spigot adapter.
Figure 8:
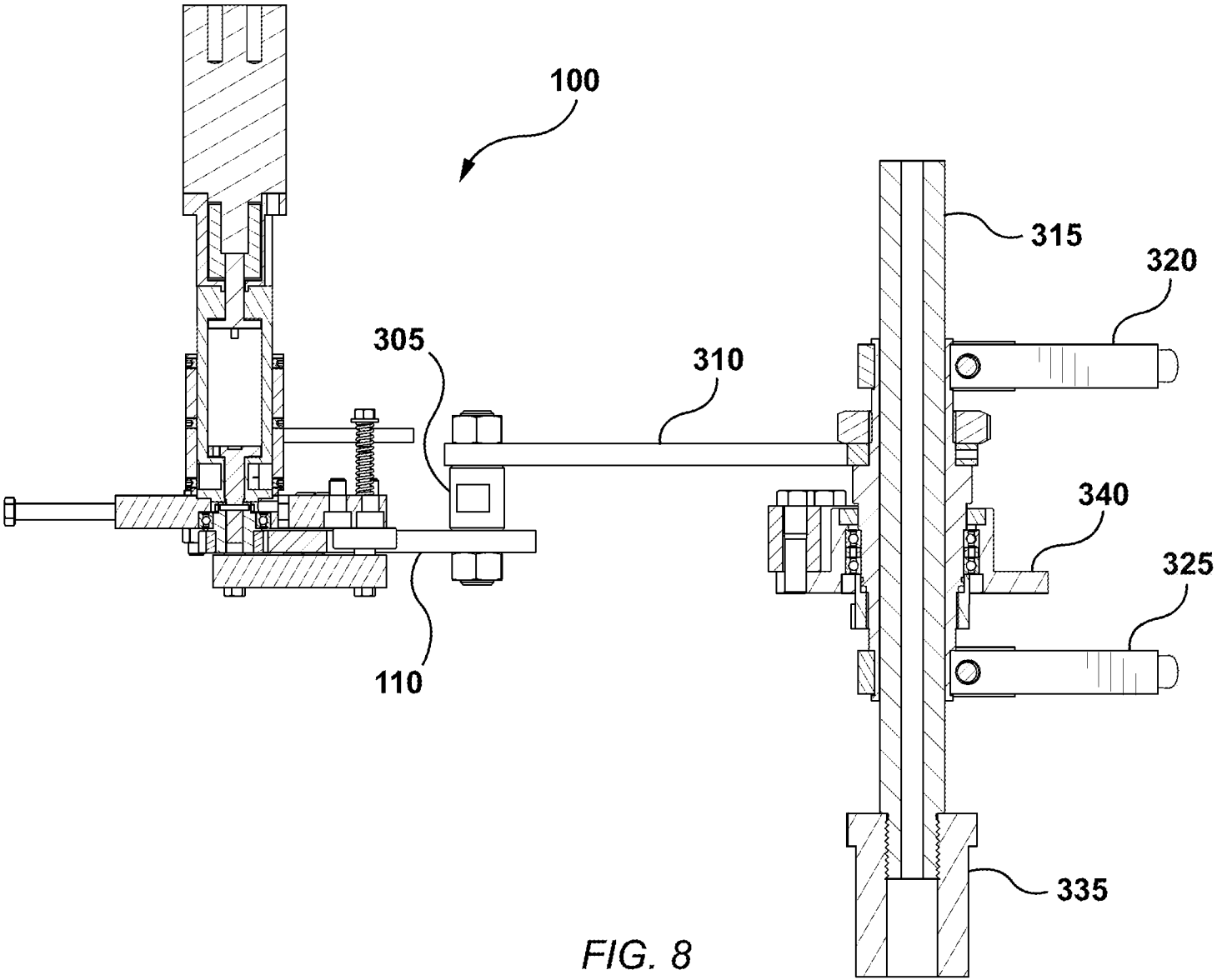
FIG. 8 is a cross-sectional view of the waterjet cutting tool shown in FIG. 7.
Figure 9:
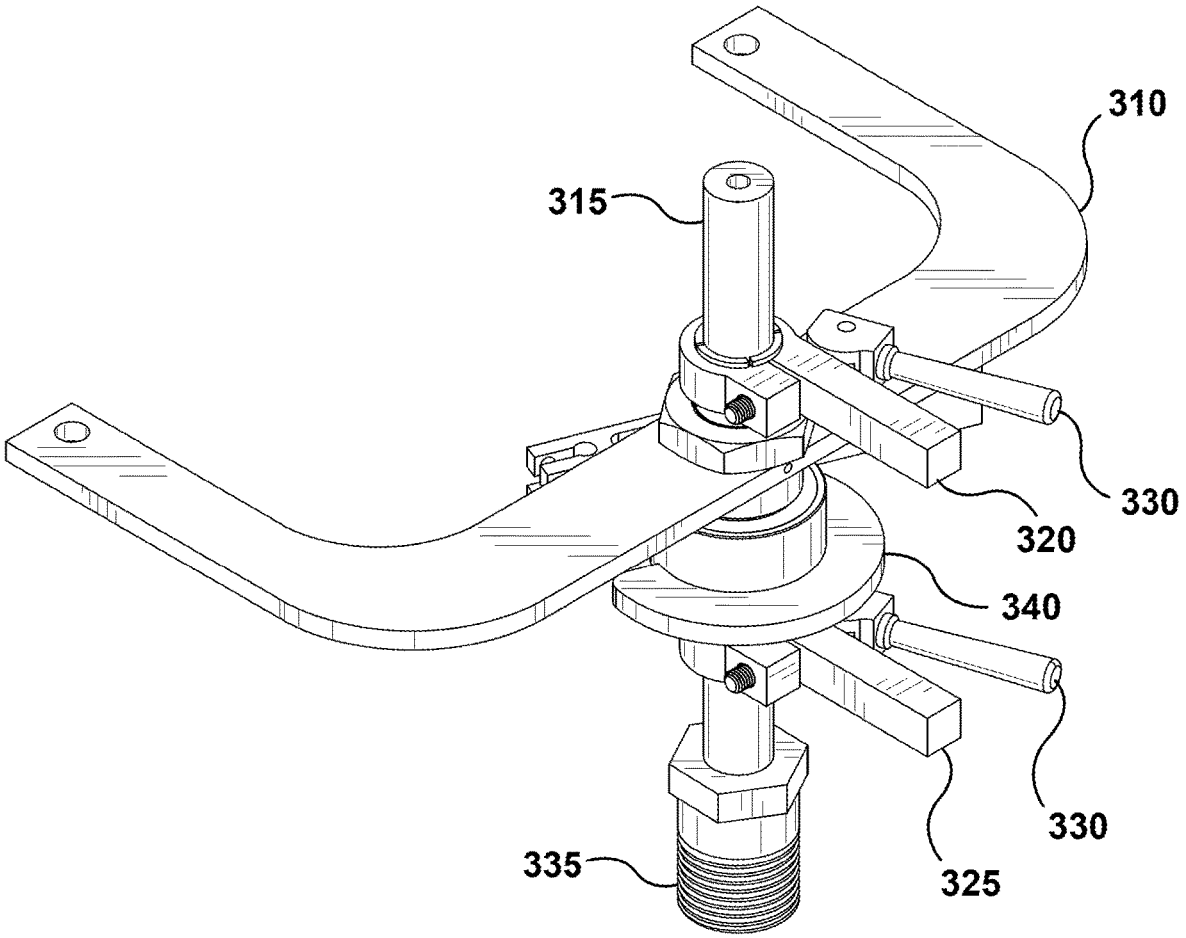
FIG. 9 is an isometric view illustrative of one embodiment of a spigot adapter that can be used with the waterjet cutting tool shown, for example, in FIG. 7.

As shown in FIGS. 7 to 9 and outlined above, the cutting tool 100 may alternatively be attached to the tubing hanger via a spigot shaft 315 and spigot adapter 335 threaded into the tubing hanger in the casing 200. This centers the cutting tool 100 about a centralized position thereby maintaining the tool at a consistent radial distance during annular rotation of the cutting tool 100 facilitating cutting of the casing and suitable components. The spigot adapter 335 may be installed first into the tubing hanger as well as the spigot shaft 315. The cutting tool 100 can then be installed on the spigot shaft 315 with a bearing 340 onto which a sector gear bracket 310 is connected. Clamps 320 and 325 may be used as needed to orient the height of the bearing 340 on the spigot shaft 315. The clamps 320 and 325 may be fast-action clamps 330 to aid in quick connection and adjustment of the bearing 340.

The bracket 310 is rotatable about the spigot shaft 315 and mounts to the sector gear track 110 and can replace the radial guide track 145 shown in FIGS. 1 to 6. The bracket 310 can be mounted to the sector gear track or other suitable component of the annular adjustment assembly via any suitable connecting or mounting device, for example using bolts 305.

The height of the tool 100 on the spigot shaft 315 can be adjusted to orient the nozzle (not shown in FIGS. 7 to 9) in a desired location.

It will be appreciated that spigot adapters 335 of various different sizes and diameters may be used to accommodate different tubing hangers.

In addition, to help reduce flexing of the cutting tool 100 when pressurized or during changes in pressurization, one or more stabilizer arms may be employed to brace the tool, for example, against the wellhead, casing, or suitable components thereof. The stabilizer arms may be bolted, clamped or even welded in place to aid in further bracing the cutting tool 100.

The carriage assembly 170 may then be radially adjusted to control the radial distance of the cutting nozzle from the casing 200 or suitable component.

The waterjet nozzle 120 is mounted to the annular adjustment assembly and, in the embodiments shown, the carriage assembly 170, with a nozzle position adjustment assembly 140 that can allow for various adjustment and orientation of the nozzle 120. This may include vertical, lateral and/or horizontal adjustment of the nozzle 120 allowing for limited or full 3-dimensional adjustment of the nozzle 120. This allows for suitable alignment and/or orientation of the nozzle 120 relative the surface or component to be cut. For example, as shown in FIGS. 1 and 2, the nozzle 120 has been oriented to cut in the area between the casing head 210 and the mating flange 215. A substantially horizontal orientation is shown. This may be used to cut the casing 200 or components thereof including the flange connection studs 220, dog bolts, etc. If desired, the pressure of the cutting solution, typically a mixture of water and sand, may be adjusted such that certain components proximate the nozzle 120 are cut while components further away remain intact. In this way, for example, the nozzle 120 may be oriented to cut the flange connection studs 220 without cutting the well casing 200.

The nozzle position adjustment assembly 140 may include various clamps, rods and hinges, ball joints or shoulder joints for example as needed to allow for greater adjustment ability. The person of skill in the art will be aware of the various components needed to allow for greater flexibility of the movement and orientation of the nozzle 120.

The person of skill in the art will be aware of suitable cutting pressures and ratios of water to sand or other suitable abrasives. In one example, a suitable cutting pressure may be between 10,000 to 50,000 psi. Pressure may also be regulated during cutting if, for example, the radial distance between the surface to be cut and the nozzle 120 fluctuates.

Any suitable waterjet cutting nozzle 120 may be used for cutting well casings and components associated thereto. The cutting nozzle 120 shown in FIGS. 1 to 6 comprises a dual coupler 160, the first coupler for input of water and the second coupler for input of sand or other suitable abrasive.

A carriage drive motor 130 may be used to drive the carriage along the radial guide track about the vertical axis of the casing. In the embodiments shown, the carriage drive motor 130 drives the carriage pinion gear 155 as the carriage pinion gear 155 is a pinion drive gear. It will be appreciated that any suitable drive motor may be used or may optionally by driven by hand or other suitable power sources.

The nozzle 120 is typically placed in a generally perpendicular orientation relative the surface to be cut and the nozzle position adjustment assembly 140 may be used to obtain proper or desirable orientation of the nozzle 120 relative the surface. One orientation for cutting a flange connection stud 220 is shown with reference to FIGS. 4A and 4B. Although the annular adjustment assembly is setup to guide the carriage assembly 170 about the casing 200 or a vertical axis thereof, the nozzle position adjustment assembly 140 may be used to orient the nozzle 120 to cut components of the casing which are off-center or off-axis such as the flange connection studs 220. In such a setup, the nozzle 120 may be oriented to a suitable cutting position relative the connection studs 220 and the carriage assembly 170 may be guided annularly along the annular adjustment assembly a suitable distance to cut the flange connection stud 220. The nozzle 120 may then be moved to the next stud 220 to be cut and the nozzle re-activated to cut the next stud 220.

The tool 100 may also be used to cut internal components of the casing and casing assembly a sleeve 240 or retaining bolts 230 as shown with reference to FIGS. 5 and 6. As such, the nozzle position adjustment assembly 140 may be used to orient the nozzle 120 in a suitable cutting position such as a vertical cutting position. The nozzle 120 may then be activated to cut components as needed in similar manner as that outlined above.

It will be appreciated that the present invention has been described with reference to various embodiments and examples, all of which are intended for illustrative and non-limiting purposes. Various modifications, alterations, adjustments, substitutions and revisions may be made without departing from the scope or spirit of the invention.

We claim:

1. A waterjet cutting tool for radial connection to a wellbore casing for cutting the wellbore casing or suitable components thereof, the waterjet cutting tool comprising:

a waterjet nozzle for outputting a cutting solution at high pressure, the waterjet nozzle for connection to a cutting solution source;

a radial adjustment unit for radially associating the waterjet nozzle to the wellbore;

an annular adjustment assembly for mount of the waterjet nozzle thereto, for allowing annular movement of the waterjet nozzle about a vertical axis of the wellbore, and a connection device for associating the waterjet cutting tool to the wellbore casing or suitable components thereof.

2. The waterjet cutting tool of claim 1, further comprising a carriage assembly in communication with the radial adjustment unit and the annular adjustment assembly, onto which the waterjet nozzle is directly or indirectly mounted.

3. The waterjet cutting tool of claim 2, wherein the radial adjustment unit is radially adjustable relative a vertical axis of the wellbore by means of a radially adjusting assembly.

4. The waterjet cutting tool of claim 3, wherein the radially adjusting assembly comprises an adjustment member for radial orientation relative the wellbore and an adjustment control operationally associated with the adjustment member for controlling the radial distance of the waterjet nozzle from the wellbore casing or suitable component.

5. The water cutter tool of claim 4, wherein the annular adjustment assembly comprises a radial guide track for interaction with the carriage assembly for movement along the radial guide track, and the carriage assembly and the radial guide track each comprise a guide element adapted for interaction therebetween for guiding the carriage assembly along the radial guide track.

6. The waterjet cutting tool of claim 4, wherein the radial adjusting assembly is integrated into the carriage assembly.

7. The waterjet cutting tool of claim 4, wherein the adjustment member is a threaded member and the adjustment control is a hand wheel or powered wheel.

8. The water cutter tool of claim 3, wherein the annular adjustment assembly comprises a radial guide track for interaction with the carriage assembly for movement along the radial guide track, and the carriage assembly and the radial guide track each comprise a guide element adapted for interaction therebetween for guiding the carriage assembly along the radial guide track.

9. The waterjet cutting tool of claim 8, wherein the radial adjusting assembly is integrated into the carriage assembly.

10. The waterjet cutting tool of claim 3, wherein the radial adjusting assembly is integrated into the carriage assembly.

11. The waterjet cutting tool of claim 2, wherein the annular adjustment assembly comprises an annular sector gear track for interaction with a carriage pinion gear mounted on the carriage assembly for guiding the carriage assembly along the sector gear track thereby adjusting an annular position of the nozzle when the carriage pinion gear is activated.

12. The waterjet cutter tool of claim 11, wherein the annular sector gear track has an annular curve such that movement along the annular sector gear track by the carriage assembly maintains a substantially consistent distance of the carriage assembly from the vertical axis of the wellbore when the cutter tool is connected to the wellbore casing.

13. The waterjet cutter tool of claim 12, further comprising a drive motor for driving the carriage assembly along the annular sector gear track.

14. The waterjet cutter tool of claim 13, wherein the drive motor is a carriage drive motor and the carriage pinion gear is a drive gear and the carriage drive motor is in connection with the carriage pinion drive gear for driving the carriage assembly along the annular sector gear track.

15. The waterjet cutting tool of claim 1, wherein the connection device comprises:

a spigot shaft for insertion into a tubing hanger, a spigot adapter for connection with the spigot shaft and securely placeable in a tubing hanger of the wellbore casing;

a bearing mounted on the spigot shaft; and a sector gear bracket connected to the bearing onto which a component of the annular adjustment assembly may be connected.

16. The waterjet cutter tool of claim 1, wherein the annular adjustment assembly further comprises a waterjet nozzle position adjustment assembly for vertically and/or horizontally adjusting the position of the waterjet nozzle.

17. The waterjet cutter tool of claim 16, wherein the waterjet nozzle position adjustment assembly allows for 3-dimensional adjustment and orientation of the waterjet nozzle.

18. A waterjet cutting tool for radial connection to a wellbore casing for cutting the wellbore casing or suitable components thereof, the waterjet cutting tool comprising:

a waterjet nozzle for outputting a cutting solution at high pressure, the waterjet nozzle for connection to a cutting solution source;

a radial adjustment unit for radially associating the waterjet nozzle to the wellbore;

an annular adjustment assembly for mount of the waterjet nozzle thereto, for allowing annular movement of the waterjet nozzle about a vertical axis of the wellbore;

a carriage assembly in communication with the radial adjustment unit and the annular adjustment assembly, onto which the waterjet nozzle is directly or indirectly mounted; and a connection device for associating the waterjet cutting tool to the wellbore casing or suitable component thereof, the connection device comprises:

a spigot shaft for insertion into a tubing hanger, a spigot adapter for connection with the spigot shaft and securely placeable in a tubing hanger of the wellbore casing;

a bearing mounted on the spigot shaft; and a sector gear bracket connected to the bearing onto which a component of the annular adjustment assembly may be connected.

* * * * *